United States Patent [19]

Frankston et al.

[11] 4,394,651

[45] Jul. 19, 1983

[54] EASTERN ARABIC NUMBER DISPLAY

[76] Inventors: Michael Frankston, 375 Harvard St., Apt. 23, Cambridge, Mass. 02139; Krikor A. Bezjian, 24 Frederick St., Belmont, Mass. 02178

[21] Appl. No.: 157,895

[22] Filed: Jun. 9, 1980

[51] Int. Cl.[3] ..... G09G 3/04

[52] U.S. Cl. ..... 340/756; 340/760

[58] Field of Search ..... 340/756–765, 340/789

[56] References Cited

U.S. PATENT DOCUMENTS

| | | | |
|---|---|---|---|
| 3,204,234 | 8/1965 | Nakauchi | 340/760 |
| 3,971,012 | 7/1976 | Morokawa et al. | 340/789 |
| 4,260,987 | 4/1981 | Osman | 340/756 |
| 4,262,291 | 4/1981 | Zammit et al. | 340/756 |

*Primary Examiner*—Marshall M. Curtis

*Attorney, Agent, or Firm*—Schiller & Pandiscio

[57] ABSTRACT

An improved array comprises eight selectively energizable segments for selectively displaying Eastern Arabic numbers. The array is particularly useful in digital display systems, such as time keeping apparatus.

16 Claims, 7 Drawing Figures

100
102
104
106
108
110
112
114
116
118
120
122
124
126A
126B
126C
128A
128B
128C
130

EASTERN ARABIC NUMBER DISPLAY

The present invention relates generally to number displays and more particularly to number displays for selectively displaying each number character of the Eastern Arabic type, instruments for use with such displays, and processes for using such displays with existing drive circuitry.

The characters of the numbering system used in most Near and Middle Eastern countries, such as the countries traditionally thought of as Arab countries as well as Iran, Pakistan and parts of India, are different than the characters of the conventional numbering system used in the West and most other countries. The characters of both numbering systems are derived from the same source, and thus can correctly be referred to as Arabic numbering systems. However, in order to distinguish between the two systems, the characters making up the numbering system of the West is hereinafter referred to as the "Western Arabic" numbers while the characters making up the Arabic numbering systems of the Near and Middle Eastern countries are collectively hereinafter referred to as the "Eastern Arabic" numbers even though one of the numbering system in Iran is slightly different than the system used in most Arab countries and even though there are also slight differences in the handwritten characters versus typewritten or printed characters representing some of the Eastern Arabic numbers.

Of the numerous displays for selectively displaying Western Arabic numbers that have been derived, one of the most popular and widely used is the seven segment array. More particularly, the Western Arabic seven segment array comprises seven segments, each an elongated bar element. The bar elements are arranged in a block-shaped figure eight nonintersecting configuration so that they can easily display any digit 0 through 9 by selectively energizing two or more of the bar elements.

The seven segment array for displaying each Western Arabic number as found wide applications, particularly in timekeeping instrumentation, such as in digital clocks and watches. Generally, such instrumentation includes drive circuitry particularly adapted for the seven segment array for sequentially changing the digit displayed to indicate the time unit. For example, a twelve hour time instrument indicating a display of the time in hours and minutes, includes a four digit display, the first two indicating the hour and the second two indicating the minutes. Specifically, the display includes a first digit array for the ten hour unit of time which is used to indicate the digit one in the on and off state. The first digit array for the ten hour unit is on when the time is between 10:00 and 12:59, inclusive and off for the remainder of the time. The second digit array displays the one hour unit of time and therefore must selectively display all of the Western Arabic numbers zero through nine, and accordingly all of the seven segments must be selectively energized. The third digit array displays the ten minute unit of time and therefore displays the Western Arabic numbers zero through five. The third array does not display the numbers six through nine since the unit changes from five to zero at the change of each hour. However, all seven segments of the third array displaying the ten minute unit must be used in order to selectively display the Western Arabic numbers 0–5. Finally, the fourth digit array for displaying the one minute unit of time displays all ten digits with the seven segment being selectively energized. Other types of Western Arabic number displays are shown and described in U.S. Pat. Nos. 3,827,043; 3,831,166; 3,945,001; and 4,034,368; and U.S. Pat. Nos. De. D204,429; D217,397; D227,602; D228,367.

Various types of Eastern Arabic numeral displays are known. For example, U.S. pat. No. 3,968,583 issued to Allam, shows an eleven segment array where eleven segments are selectively utilized to display all ten characters of the Eastern Arabic number system. This display suffers from the disadvantage that it is rather complex and requires the use of display segments of narrowly restricted shape. West German Offenlegungsschrift No. 2606946 (Omron) shows an eleven and a twelve segment array for selectively displaying each Eastern Arabic number. West German Offenlegungsschrift No. 2622169 (Brose) shows a ten segment array for displaying each of the Eastern Arabic numbers, while British publication GB2001468A to Zammit et al. discloses a sixteen segment array for the same purpose. Another Eastern Arabic number display which has been used in electronic calculators is a nine segment array for each character displayed.

A disadvantage of the Eastern Arabic number displays of the above-noted prior art is that at least some of the number characters are of different relative sizes than that of the printed form, or appear in different, shifted positions with differenct centerings within the character field. For example, in the display shown in the Allam patent, the character corresponding to the number five is displayed on the right side of the character field, while the character corresponding to the number eight is displayed on the left side of the character field.

Further, the above-mentioned prior art Eastern Arabic number displays are not easily if at all adaptable for use with the existing drive circuitry that is used to drive the Western Arabic seven segment number displays. In general the circuitry used to drive the Western Arabic seven segment number display is designed to drive a display that has a seven segment array for each digit unit with the exception of the ten hour unit of a digital timekeeping instrument. Thus, in order to drive a display with nine, ten, twelve or more segments per time unit, a totally different and more complex circuit design or format is required, one which would employ many more electrical leads or equivalent mechanical devices. In circuit designs that employ time addressing (by multiplexing) and/or energizing of segments, the electrical control waveforms for selectively energizing the segments of a seven segment array are much simpler than those for energizing the arrays of more than eight segments for each digit unit.

It is therefore a general object of the present invention to provide a simpler display for selectively displaying each number character of the Eastern Arabic type.

Another object of the present invention is to provide a simpler display for selectively displaying each number character of the Eastern Arabic type in which each number is of approximately the same relative size as used in the printed form of which is more centered in the character field.

And another object of the present invention is to provide an eight segment array for displaying each number of the Eastern Arabic type.

Still another object of the present invention is to provide an array of plural selectively energizable segments for selectively displaying each of the Eastern Arabic numbers, the array being easily adaptable so that it can be driven with existing drive circuitry designed for use with a standard seven segment Western Arabic number display.

Yet another object of the present invention is to provide an improved instrument of the type for displaying digital numbers of the Eastern Arabic type.

And still another object of the present invention is to provide an improved device, such as a time-keeping instrument, of the type including drive circuitry compatible with the standard seven segment array, which is easily modified to selectively display each of the Eastern Arabic numbers on an eight segment number display.

And yet another object of the present invention is to provide an improved process of using an Eastern Arabic number display with existing drive circuit for the standard seven segment Western Arabic number display.

These and other objects of the present invention are provided by a display comprising eight selectively energizable segments, each shaped and positioned in a predetermined array so that each of the Eastern Arabic numbers are selectively displayed in an easily readable form.

Other objects of the invention will in part be obvious and will in part appear hereinafter. The invention accordingly comprises the apparatus processing the construction, combination of elements and arrangement of parts and the processes involving the several steps and the relation of one or more of such steps with respect to each of the other which are exemplified in the following detailed disclosure, and the scope of the application of which will be indicated by the claims.

For a fuller understanding of the nature and objects of the present invention, reference should be had to the following detailed description taken in connection with the accompanying drawings wherein.

Figure 1:
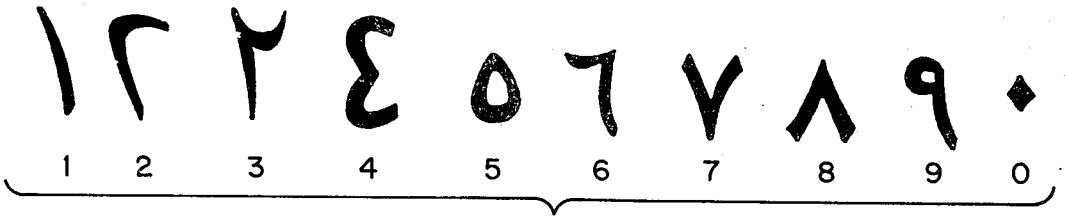
FIG. 1 shows characters representing the Eastern Arabic numbers in the handwritten form of most Middle and Near Eastern countries.
Figure 2:
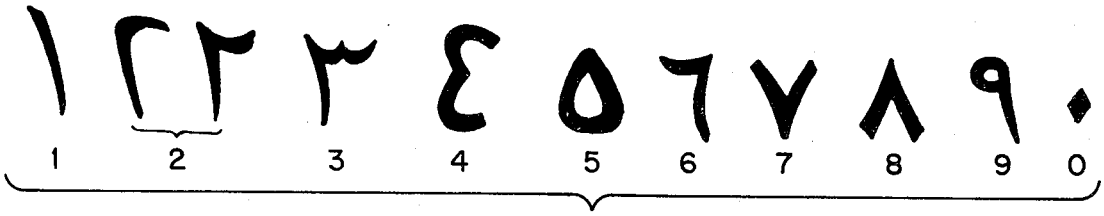
FIG. 2 shows the characters representing the Eastern Arabic numbers in typewritten and printed form as well as a handwritten form used in Iran.

Referring to FIGS. 1 and 2 of the drawings it can be seen that the characters of FIG. 1 which are handwritten Eastern Arabic numbers used in most Middle and Near Eastern countries, while the characters of FIG. 2 correspond to the typewritten and printed Eastern Arabic numbers in those countries as well as handwritten, typewritten and printed numbers presently used in Iran. As shown, the characters representing the numbers one, four through nine and zero are substantially the same in both FIGS. 1 and 2. The character representing number two may be substantially the same for both forms of FIGS. 1 and 2, or may vary wherein the typewritten form of FIG. 2 may appear to be similar to the FIG. 1 characters representing the number three. Consequently, the character representing the number three differs in FIGS. 1 and 2.

It is therefore the preferred approach of the present invention to display the Eastern Arabic numbers in a font which more closely resembles each of the characters shown in FIG. 2 to avoid confusion which might arise from using the character of FIG. 1 representing the number three with the character of FIG. 2 representing the number two. It will be appreciated however, that it is within the scope of the present invention to also display the Eastern Arabic numbers in a font which resembles the characters shown in FIG. 1, as will be evident hereinafter.

Figure 3:
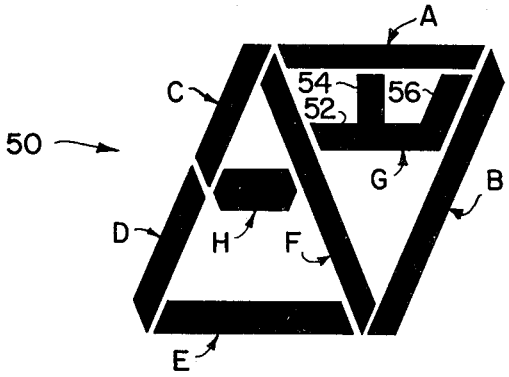
FIG. 3 illustrates the preferred embodiment of the number display of the present invention.
Figure 4A:
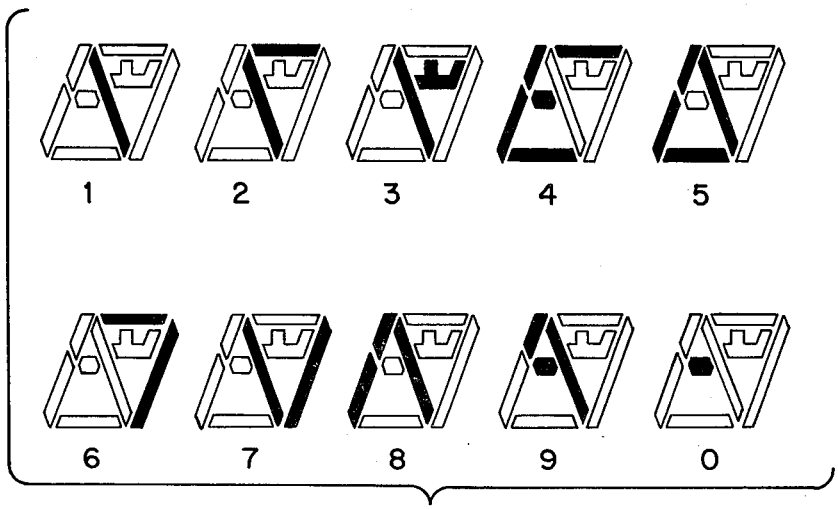
FIG. 4A shows those elements of the display of FIG. 3 which are energized for displaying each number character of the type shown in FIGS. 1 and 2.
Figure 4B:
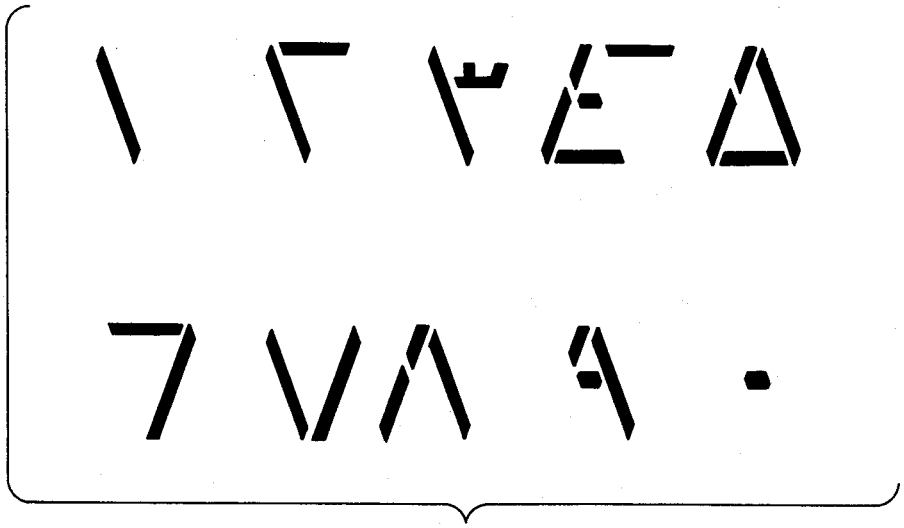
FIG. 4B shows the resulting font provided by the display of each number character of the type shown in FIGS. 1 and 2.

The preferred array shown in FIG. 3 allows each character of FIG. 2 to be selectively displayed by energizing select ones of the segments as shown in FIG. 4A to provide the font of FIG. 4B. Each of the segments can be any type of selectively energizable device such as a liquid crystal, light emitting diode or vacuum fluorescent bulb. Similar devices are known in the art.

The preferred array 50 of FIG. 3 comprises the eight nonintersecting segments labelled A,B,C,D,E,F,G and H. Segments A,B,C,D,E, and F are substantially elongated elements all preferably of approximate equal thickness in appearance. The segments are oriented with respect to one another such that when viewing the display in its proper orientation, five of the elongated segments A,B,C,D and E are positioned relative to one another to form an "apparent" quadrilateral, preferably in the shape of a parallelogram, which defines the boundary of the character field. The term "apparent" quadrilateral is used to designate not only the geometric configuration shown wherein each elongated segment A,B,C,D and E is shown as a straight element, but also those geometric configurations where any or all of the segments A,B,C,D and E (although in their same relative position) are curved to provide more of a script appearance. When viewed at its proper orientation the five segments A,B,C,D and E of the array lean to the right about 20 degrees from the vertical to provide the best results.

The two elements A and E form the respective top and bottom of the parallelogram. The third element B forms the right hand side of the parallelogram, while the remaining two segments C and D extend substantially co-linearly with respect to one another and form the left hand side of the parallelogram.

The sixth segment F is also elongated and extends from the approximate top left corner to the approximate bottom right corner of the parallelogram so as to form a diagonal of the parallelogram, dividing the latter into left and right triangular portions. Segment F is shown straight, although it also may be curved depending upon whether a script appearance of the numbers is desirable.

The seventh and eight segment H and G are disposed respectively in the left and right triangular portions defined by the parallelogram and the segment F diagonal. Segment H as shown is longer in its horizontal dimension than its vertical dimension so as to form a slightly elongated element disposed substantially parallel to the segment E. The opposite, left and right ends of segment H each taper to a point, as shown. The segment H is positioned with its left end adjacent the opposing edges of and thus the space between segments C and D. Segment G includes a horizontally oriented section 52 having its left edge terminating adjacent the segment F, with the left edge being slanted so as to be substantially parallel to the elongated direction of segment F. Segment G also includes a center, vertically oriented section 54 extending from the horizontally oriented section 52 and terminating at its edge, adjacent to the approximate center of the segment A. Segment G also includes an end section 56 extending from the right end of the horizontally oriented section 52 parallel to segment B and terminating at its edge below and adjacent to the right edge of segment A.

In order to display each of the numerals of Eastern Arabic type, the segments A,B,C,D,E,F,G and H are selectively energized as shown in FIG. 4A and as detailed in the following truth table.

TRUTH TABLE I

| Eastern Arabic Number to be Displayed | Segments to be Energized |
|---|---|
| \ (one) | F |
| <(two) | A,F |
| ⋜(three) | F,G |
| ϵ (four) | A,C,D,E,H |
| ∘ (five) | C,D,E,F |
| >(six) | A,B |
| ˇ (seven) | F,B |
| ^ (eight) | C,D,F |
| a (nine) | C,F,H |
| • (zero) | H |

It should be appreciated that although the above Truth Table and the energization of the segments illustrated in FIG. 4A is preferred, the Eastern Arabic number one can also be illustrated by selectively energizing segment B or alternatively segments C and D. Similarly, the Eastern Arabic number two can also be illustrated by selectively energizing segments A, C and D. In addition, where it is desirable to display the numbering system of FIG. 1, the array 50 can be easily modified to display the characters by simply modifying segment G. In particular segment G is modified to delete the center section 54 having only sections 52 and 56. Section 56 can also be deleted and, the horizontally oriented section 52 curved with its concave side facing upward so that when energized with segment F to display the Eastern Arabic number 3, the upper portion of the character more nearly resembles the upper portion of the character 3 shown in FIG. 1.

The array of FIG. 3 is an improvement over the prior art arrays for displaying Eastern Arabic numbers by reducing the number of segments from a minimum of nine segments as provided in the prior art to eight segments and yet provide an easy to read font style for each of the Eastern Arabic numbers. The eight segment array 50 has particular utility in digital display systems such as time-keeping instruments since both Western and Eastern Arabic time-keeping systems are based upon a 60 minute hour and 60 second minute.

The advantages of the eight segment array 50 for time-keeping systems will be more evident from the following discussion. A segmented array of a digital time display that indicates the number of ten minute units (as well as the array indicating the number of ten second units) of both Eastern and Western Arabic displays need only selectively indicate the numbers zero through five, since an increment of one minute when fifty-nine minutes is displayed resets the displayed number of minutes to zero, zero, and similarly an increment of one second when fifty-nine seconds is displayed resets the displayed number of seconds to zero, zero.

Referring to Truth Table I above, when displaying the Eastern Arabic numbers zero through five, as shown in FIG. 4A, segments C, D and E are either energized together or left unenergized. Thus, the segments C, D and E of each array displaying the ten minute and ten second units can be thought of as a single segment either by combining them as one segment or by energizing all three segments with the same signal. Since only four other segments, segments A, F, G, and H are used to display the six numbers, a total of only five selectively energizable segments or at least only five energizing signals are needed in display a ten minute unit of time or a ten second unit of time. Further, the ten hour unit of time need only display the Eastern Arabic number one and accordingly need only comprise one segment, i.e. segment F. Thus, to display hours and minutes in Eastern Arabic numbers the total number of segments (or at least independent leads) required is 22 (the ten hour unit of time requiring one segment, the one hour unit of time requiring eight segments, the ten minute unit requiring five segments and the one minute unit of time requiring eight segments). The requirement for 22 segments and thus 22 drive leads is exactly the same as those required in the hour and minute displays of Western Arabic numbers using the standard seven segment display. Thus, the same drive circuitry for such Western Arabic numbers can be easily used with the array of the instant invention with only minor modifications being necessary. The foregoing will be more evident from the following description of and references to FIGS. 5 and 6.

Figure 5:
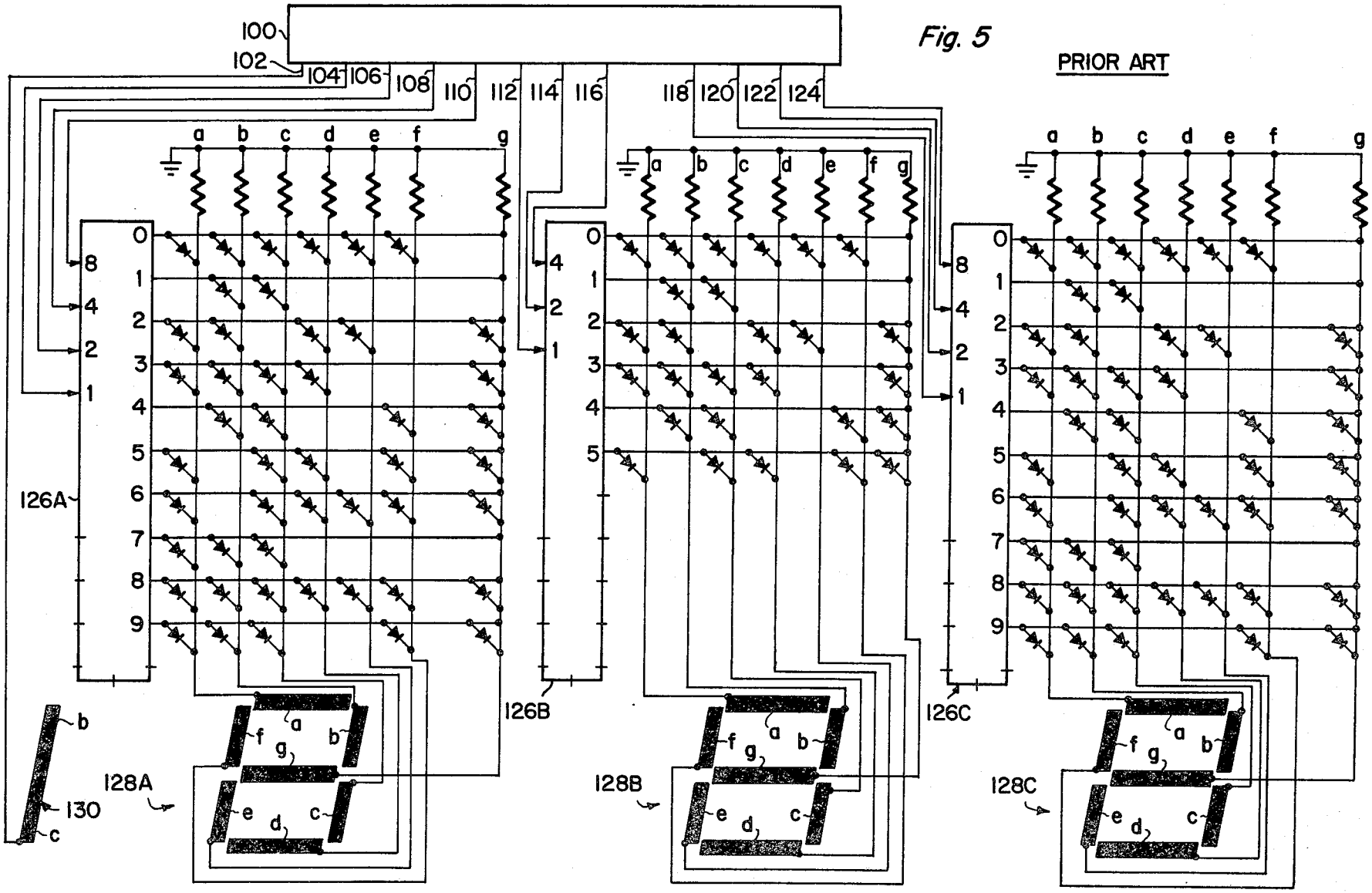
PRIOR ART Fig. 5
FIG. 5 shows a prior art instrumentation system utilizing known drive circuitry for selectively driving a standard seven segment number display for selectively displaying each number of the Western Arabic type.
Figure 6:
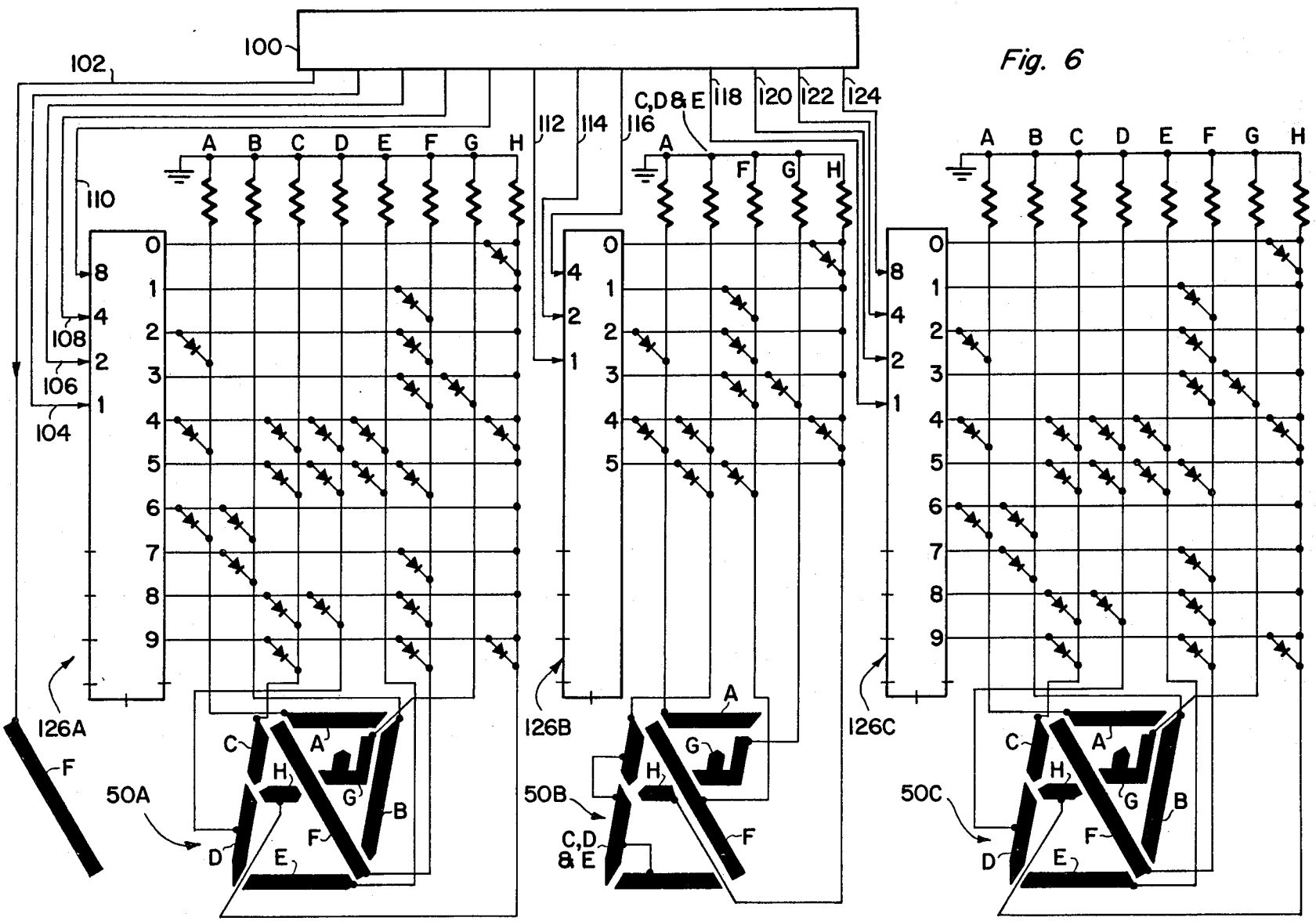
FIG. 6 shows an embodiment of an instrument modified in accordance with the present invention for adapting the drive circuitry of the FIG. 5 system for use with the display of FIG. 3.

In FIG. 5, a prior art system for keeping time is shown as including a digital display for displaying hours and minutes in Western Arabic style numbers. The instrument includes circuit 100 well known in the art for sequentially providing binary coded signals representative of the time. Circuitry 100 can be in integrated circuit form such as described in detail in Hyltin, Tom M., *The Digital Electronic Watch,* Van Nostrand Reinhold Company, New York, 1978.

The output of circuitry 100 as shown provides binary coded signals representative of hours and minutes, with line 102 providing a signal representative of the ten hour unit, lines 104, 106, 108, 110 providing the one hour unit, lines 112, 114, and 116 providing the ten minute unit and lines 118, 120, 122, and 124 providing the one minute unit.

The circuit 100 is connected to the display comprising the standard seven segment array 128. Array 128 comprises segments a, b, c, d, e, f, g and h as shown. The line 102 can be directly connected to segments b and c connected together to form the segment 130 which is representative of the ten hour unit. The lines 104, 106, 108, and 110 provide signals representative of the binary codes 1, 2, 4 and 8 respectively and are connected to the appropriate binary inputs of a binary-to-decimal converter 126A for converting binary coded signals to decimal signals. Such converters are well known in the art and will not be explained in great detail. Generally, when the binary code of 0 is represented no signals are provided over lines 104, 106, 108 and 110 to the respective 1, 2, 4 and 8 binary inputs of the converter 126A. This results in a signal being provided at the 0 decimal output of the converter. The binary code of 1 is provided by a signal over line 104 to the 1 binary input of the converter 126A while the remaining inputs remain unenergized. This results in an output signal at the 1 decimal output. The binary code of 2 is provided by a signal input over line 106 to the 2 binary input of the converter 126A while the remaining inputs are unenergized. This causes an output signal at the 2 decimal output. As well known the binary code of 3 is provided by signal inputs over both lines 104 and 106 to the 1 and 2 binary inputs of the converter while the remaining inputs remain unenergized. This results in an output of the 3 decimal output. The decimal outputs of 4–9 are similarly provided by the appropriate combination of inputs of binary signals to the converter 126A as well known in the art. Converters 126B and 126C operate in a similar fashion with respect to signals provided over lines 112, 114 and 116, and line 118, 120, 122, and 124, respectively. The decimal outputs of the converters 126A, 126B, and 126C are respectively connected to the seven segment arrays 128A, 128B, and 128C so that the one hour unit of time, the ten minute unit of time and the one minute unit of time will be displayed. More particularly, each decimal signal output line of the converters 126A, 126B and 126C is shown in a horizontal orientation in FIG. 5, while each lead for the corresponding segments a, b, c, d, e, f, and g of the standard seven segment array is shown oriented in the vertical direction. Each decimal signal output is connected through a separate diode to each of the appropriate segments in accordance with the following Truth Table II as well known in the art.

TRUTH TABLE II

| Western Arabic Number to be displayed | Segments Energized |
|---|---|
| \ (one) | b,c |
| < (two) | a,b,g,e,d |
| ⊂ (three) | a,b,g,c,d |
| ϵ (four) | f,g,b,c |
| ∘ (five) | a,f,g,c,d |
| > (six) | a,f,e,d,c,g |
| ˇ (seven) | a,b,c |
| ^ (eight) | a,b,c,d,e,f,g |
| a (nine) | a,f,g,b,c |
| • (zero) | a,b,c,d,e,f |

For example, the decimal output for the Western Arabic number 1 is connected through a diode to segments b and c of the seven segment array while remaining unconnected to the segments a,d,e,f and g. Similar connections are made for the remaining numbers as prescribed by the Truth Table II.

In operation, the circuit 100 provides signals to sequentially increment the one minute unit of time displayed on array 128C at the expiration of each minute, the ten minute unit displayed on array 128B is incremented with the expiration of each ten minutes, returning to zero after five, and the one hour unit of time is incremented on array 128A with the expiration of each hour. The ten hour unit of time displayed on segment 130 is energized between 10:00 and 12:59, and off for the remaining time. As will be evident the total number of segments, and thus drive leads used to display the time in hours and minutes on segment 130 and arrays 128A, 128B and 128C is twenty-two.

The eight segment array of FIG. 3 therefore can easily be used with circuit 100 with minor modifications to accommodate the Truth Table I associated with the array of FIG. 3. More specifically, referring to FIG. 6, the same circuit 100 and binary leads 102–124 as well as binary-to-decimal signal converters 126A, 126B, and 126C of FIG. 5 can be used. The biasing lead 102 can be connected to an array comprising only segment F for indicating the ten hour unit of time. The arrays 128A, 128B and 128C at the FIG. 5 system are respectively replaced by the arrays 50A, 50B and 50C. Since the one minute and one hour unit arrays 50A and 50C each comprise eight selectively energizable segments, each are shown as having eight vertical drive leads as shown. As previously described the ten minute unit array 50B need only include five selectively energizable segments, with segments C, D, and E being combined as one segment. The specific decimal signal outputs of converters 126A, 126B, and 126C are converted through diodes to the appropriate segments of the arrays in accordance with the previously described Truth Table I so that any particular decimal signal output unit selectively energizes the appropriate segments to provide the display of the corresponding number in the Eastern Arabic style. Since only 22 segments and thus 22 leads are used in the display system of FIG. 6, existing manufacturing techniques and parts associated with making the system of FIG. 5 can easily be used in the FIG. 6 embodiment with only minor modifications.

The eight segment array of FIG. 3 for selectively displaying each of the Eastern Arabic numbers is thus an improvement over the above-noted prior art displays of nine or more segments since (a) a simpler display is provided, (b) the characters displayed are (1) of a more uniform size in an easy to read font style as shown in FIG. 4B, and (2) are more centered in the character field, and (c) a display comprising the array can easily be adapted to be used with existing drive circuitry designed for use with standard seven segment Western Arabic numeral displays, particularly in digital timekeeping systems.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. A multiple segment number display for selectively displaying each Eastern Arabic number, said display comprising eight segments, six of said segments being substantially elongated, said segments being oriented with respect to one another such that when viewing said display in its proper orientation, (a) five of said elongated segments are arranged to form an apparent quadrilateral, the first and second of said five elongated segments forming the respective top and bottom of said quadrilateral, a third of said five elongated segments forming the right hand side of said quadrilateral, and the remaining fourth and fifth segments of said five elongated segments extending substantially colinearly with respect to one another, the fourth segment disposed above said fifth segment, so as to form the left hand side of said quadrilateral, (b) the sixth elongated segment extends from the approximate top left corner of said quadrilateral to the approximate bottom right corner of said quadrilateral so as to form a diagonal of said quadrilateral dividing said quadrilateral into left and right triangular portions, and, (c) the seventh and eighth segments are disposed respectively in the left and right triangular portions;

wherein said eight segments are selectively energizable so as to display each of said Eastern Arabic numbers.

2. A display according to claim 1, wherein said quadrilateral is a parallelogram leaning to the right.

3. A display according to claim 2, wherein said parallelogram leans to the right at an approximate 20 degree angle to the vertical.

4. A display according to claim 1, wherein said segments are non-intersecting.

5. A display according to claim 1, wherein said elongated elements are each of a substantially equal thickness.

6. A display according to claim 1, wherein said seventh segment is disposed above said second elongated segment and terminates at its left edge adjacent the position of the opposing ends of said fourth and fifth segments.

7. A display according to claim 1, wherein said eighth segment comprises a horizontal section disposed below said first segment.

8. A display according to claim 6, wherein said eighth segment further includes a center section extending from the approximate center of said horizontal section toward the center of said first segment, and an end section extending from the right end of said horizontal section parallel to said third segment and toward said first segment.

9. A display according to claim 1, wherein the characters representing the Eastern Arabic numbers are selectively displayed by selectively energizing the segments of said display in accordance with the following truth table:

TRUTH TABLE

| Eastern Arabic number to be displayed | Segment to be Energized |
|---|---|
| \ (one) | sixth |
| <(two) | first and sixth |
| ⊂(three) | sixth and eighth |
| ϵ (four) | first, fourth, fifth, second and seventh |
| ∘ (five) | fourth, fifth, second and sixth |
| >(six) | first and third |
| ˇ (seven) | third and sixth |
| ^ (eight) | fourth, fifth and sixth |
| a (nine) | fourth, sixth and eighth |
| • (zero) | seventh |

10. A multiple segment number display for selectively displaying the font as shown in FIG. 4B.

11. In an apparatus of the type for displaying numbers and including signal generating means adapted to be used with a digital display of the type including a seven segment array for selectively displaying any one of the Western Arabic numbers, said signal generating means generating an output representative of any preselected one of the Western Arabic numbers to be displayed on said seven segment array, said apparatus further including means responsive to said output for selectively providing an energizing signal to each segment of said seven segment array so as to selectively display said Western Arabic number represented by said output, wherein the improvement comprises:

an Eastern Arabic number display including at least one eight segment array consisting of eight segments, each segment being selectively energizable responsively to a corresponding drive signal, for selectively displaying with said eight segment array any one of the Eastern Arabic numbers, and signal conversion means electrically coupled to said signal generating means and to said Eastern Arabic number display and including means for converting said output of said signal generating means to said drive signals, and means for selectively providing each drive signal to the appropriate segment of said eight segment array such that the Eastern Arabic number displayed by said eight segment array in response to said drive signals correponds to the same Western Arabic number that would be displayed by said seven segment array in response to the energizing signals provided in response to said output.

12. Apparatus according to claim 11, wherein said apparatus is a time-keeping system capable of displaying at least hours and minutes in digital form, and wherein the total number of separate selectively energizable segments of said Eastern Arabic number display is the same as the separate selectively energizable segments of said digital display of the type including a seven segment array.

13. Apparatus according to claim 12, wherein said total number of separate selectively energizable segments of said Eastern Arabic number display for displaying the hours and minutes is 22.

14. Apparatus according to claim 11, wherein six of said segments of said eight segment array are substantially elongated, and said eight segments are oriented with respect to one another such that when viewing said display in its proper orientation, (a) five of said elongated segments are arranged to form an apparent quadrilateral, the first and second of said five elongated segments forming the respective top and bottom of said quadrilateral, a third of said five elongated segments forming the right hand side of said quadrilateral, and the remaining fourth and fifth segments of said five elongated segments extending substantially colinearly with respect to one another, the fourth segment disposed above said fifth segment, so as to form the left hand side of said quadrilateral, (b) the sixth elongated segment extends from the approximate top left corner of said quadrilateral to the approximate bottom right corner of said quadrilateral so as to form a diagonal of said quadrilateral dividing said quadrilateral into left and right triangular portions, and (c) the seventh and eighth segments are disposed respectively in the left and right triangular portions;

wherein said eight segments are selectively energizable so as to display each of said Eastern Arabic numbers.

15. Apparatus according to claim 14, wherein the characters representing the Eastern Arabic numbers are selective displayed by selectively energizing the segments of said eight segment array with respective ones of said drive signals in accordance with the following truth table:

TRUTH TABLE

| Eastern Arabic number to be displayed | Segment to be Energized |
|---|---|
| \ (one) | sixth |
| < (two) | first and sixth |
| ⌄ (three) | sixth and eighth |
| ϵ (four) | first, fourth, fifth, second and seventh |
| ∘ (five) | fourth, fifth, second and sixth |
| > (six) | first and third |
| ˇ (seven) | third and sixth |
| ^ (eight) | fourth, fifth and sixth |
| a (nine) | fourth, sixth and eighth |
| • (zero) | seventh |

16. Apparatus for displaying Eastern Arabic numbers with signal generating means of the type which is adapted to be used with a digital display including a seven segment array for selectively displaying any one of the Western Arabic numbers, the signal generating means being adapted to generate an output signal representative of any preselected one of the Western Arabic numbers to be displayed on the seven segment array, the seven segments of the array being selectively energized in response to each output signal of the signal generating means in accordance with a first truth table said apparatus comprising:

means for forming an Eastern Arabic number display comprising an array of only eight segments for selectively displaying each of the Eastern Arabic numbers; and means for coupling said segments of said Eastern Arabic number display to said signal generating means so that said eight segments of the array are selectively energized in response to each output of said signal generating means in accordance with a second truth table.

* * * * *

UNITED STATES PATENT AND TRADEMARK OFFICE

CERTIFICATE OF CORRECTION

PATENT NO. : 4,394,651

DATED : July 19, 1983

INVENTOR(S) : Michael Frankston et al

It is certified that error appears in the above-identified patent and that said Letters Patent is hereby corrected as shown below:

Column 5, line 30, TRUTH TABLE I, please delete "a" and substitute therefor -- q --; and Column 7, line 43, TRUTH TABLE II, please delete "a" and substitute therefor -- q --.

Claim 9, column 9, line 53, TRUTH TABLE, please delete "a" and substitute therefor -- q --;

Claim 11, column 10, line 17, please delete "correponds" and substitute therefor -- corresponds --;

Claim 15, column 10, line 65, please delete "selective" and substitute therefor -- selectively --; and Claim 15, column 11, line 14, TRUTH TABLE, please delete "a" and substitute therefor -- q --.

Signed and Sealed this

*Eighteenth* Day of *October 1983*

[SEAL]

*Attest:*

GERALD J. MOSSINGHOFF

*Attesting Officer*

*Commissioner of Patents and Trademarks*